US005601250A

United States Patent [19]

Wheeler et al.

[11] Patent Number: 5,601,250

[45] Date of Patent: Feb. 11, 1997

[54] STRIP ACCUMULATOR

[75] Inventors: Michael S. Wheeler, Chagrin Falls; Orst P. Kurylo, Norton, both of Ohio

[73] Assignee: Guild International Inc., Bedford, Ohio

[21] Appl. No.: 590,788

[22] Filed: Jan. 24, 1996

[51] Int. Cl.[6] ..... B65H 20/26

[52] U.S. Cl. ..... 242/364.1

[58] Field of Search ..... 242/364, 364.1, 242/364.2, 328, 328.1, 328.2

[56] References Cited

U.S. PATENT DOCUMENTS

| | | | |
|---|---|---|---|
| 3,258,212 | 6/1966 | La Tour | 242/364.1 |
| 3,782,662 | 1/1974 | Miller | 242/364.1 |
| 3,860,188 | 1/1975 | Bradshaw | 242/364.1 |
| 4,410,121 | 10/1983 | Wheeler et al. | 226/118 |
| 4,456,189 | 6/1984 | Wheeler et al. | 242/364.1 |
| 4,473,193 | 9/1984 | Cooper et al. | 242/364.1 |
| 4,529,140 | 7/1985 | Cooper et al. | 242/364.1 |

FOREIGN PATENT DOCUMENTS

| | | | |
|---|---|---|---|
| 2357144 | 5/1974 | Germany | 242/364.1 |

*Primary Examiner*—Michael R. Mansen

*Attorney, Agent, or Firm*—Renner, Otto, Boisselle & Sklar, P.L.L.

[57] ABSTRACT

A strip accumulator for supporting a continuous length of strip material includes a plurality of circumferentially spaced stationary idler rolls for supporting an inner bundle of convolutions of the strip material on edge and an outer rotatable table surrounding the stationary idler rolls for supporting an outer bundle of such strip convolutions on edge. During overspeed filling of the accumulator, lifters are activated to facilitate transfer of the convolutions from the inner bundle to the outer bundle. Circumferentially spaced, radially extending skid bars may be provided on the upper surface of the rotatable table to reduce drag on the strip material during such transfer of the strip material from the stationary idler rolls to the rotatable table during overspeed filling of the accumulator. When the accumulator is filled to the desired capacity, the lifters are lowered out of the way so as not to interfere with the smooth transfer of the convolutions from the outer bundle to the inner bundle. Relatively short rods or bars are provided in the gap between the rotatable table and stationary idler rolls to prevent irregular or bent strip from getting hung up in the gap during transfer of the strip material from the rotatable table to the stationary idler rolls.

26 Claims, 3 Drawing Sheets

STRIP ACCUMULATOR

FIELD OF THE INVENTION

This invention relates to a strip accumulator for storing a sufficient length of strip material received from a source of supply (e.g. a coil of strip material) to be able to feed to the strip material to a mill, machine or other apparatus without interruption while the coil is being replenished/replaced.

BACKGROUND OF THE INVENTION

Strip accumulators of various types have long been used for storing a continuous length of strip material in an expanding and contracting spiral coil having a fixed number of turns with the strip material entering the outer diameter of the coil and withdrawn from the inner diameter or vice versa.

A major drawback of most accumulators is the time it takes to fill the accumulators to capacity after the supply of strip material has been replenished. The maximum fill speed of most accumulators is approximately 2.6 times the maximum line speed. This is particularly disadvantageous when processing thicker strip material with less footage in each coil or when processing smaller coils of any thickness of strip material in that the end of a new coil of strip material may be reached before the accumulators are filled to capacity, thus cutting down on the time available for the operator to replenish the supply by making coil changes and end welds without interruption or slowdown of the line.

SUMMARY OF THE INVENTION

With the foregoing in mind, it is a principal object of this invention to provide a strip accumulator which is capable of overspeed filling of the accumulator with strip material, at speeds substantially in excess of 2.6 times the maximum line speed.

These and other objects of the present invention may be achieved by providing the accumulator with a plurality of circumferentially spaced stationary idler rolls for supporting an inner bundle of convolutions of strip material on edge and an outer rotatable table surrounding the stationary idler rolls for supporting an outer bundle of such strip convolutions on edge, the convolutions of both bundles being one continuous length of strip material. During the fill mode, lifters are activated to facilitate transfer of the convolutions from the inner bundle to the outer bundle. To that end, the lifters include lifter bars that are moved upward and radially outward to intersect the plane of the upper surfaces of the stationary idler rolls at a slight angle to gradually lift the convolutions from the inner bundle off the stationary idler rolls and deposit such convolutions onto the rotating table during expansion of such convolutions.

When the lifters are in the upper or raised position, the radial outer ends of the lifters radially overlap the radial inner edge of the rotating table. This may be accomplished by providing corresponding tapered surfaces on the underside of the radial outer ends of the lifters and upper side of the radial inner edge of the table.

When the accumulator is filled to the desired capacity, the lifters are lowered out of the way so as not to interfere with the smooth transfer of the convolutions from the outer bundle to the inner bundle during both mill match operation of the accumulator when the rate of infeed of the strip material to the accumulator matches the rate of outfeed of the strip material from the accumulator and during the strip replenishing or welding mode when movement of the incoming strip material is stopped to replenish the source of supply of strip material exteriorly of the accumulator while strip material is still being withdrawn from the accumulator at line speed.

Relatively short rods or bars may be provided in the gap between the rotatable table and stationary idler rolls to prevent irregular or bent strip from getting hung up in the gap between the outer table and stationary idler rolls during transfer of the strip material from the rotatable table to the stationary idler rolls. Also, a plurality of relatively narrow radially extending skid bars may be mounted in circumferentially spaced relation on the upper surface of the rotatable table to reduce drag on the strip material during transfer of the strip material from the inner bundle to the outer bundle during overspeed filling of the accumulator.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DESCRIPTION OF THE PREFERRED EMBODIMENT

Figure 1:
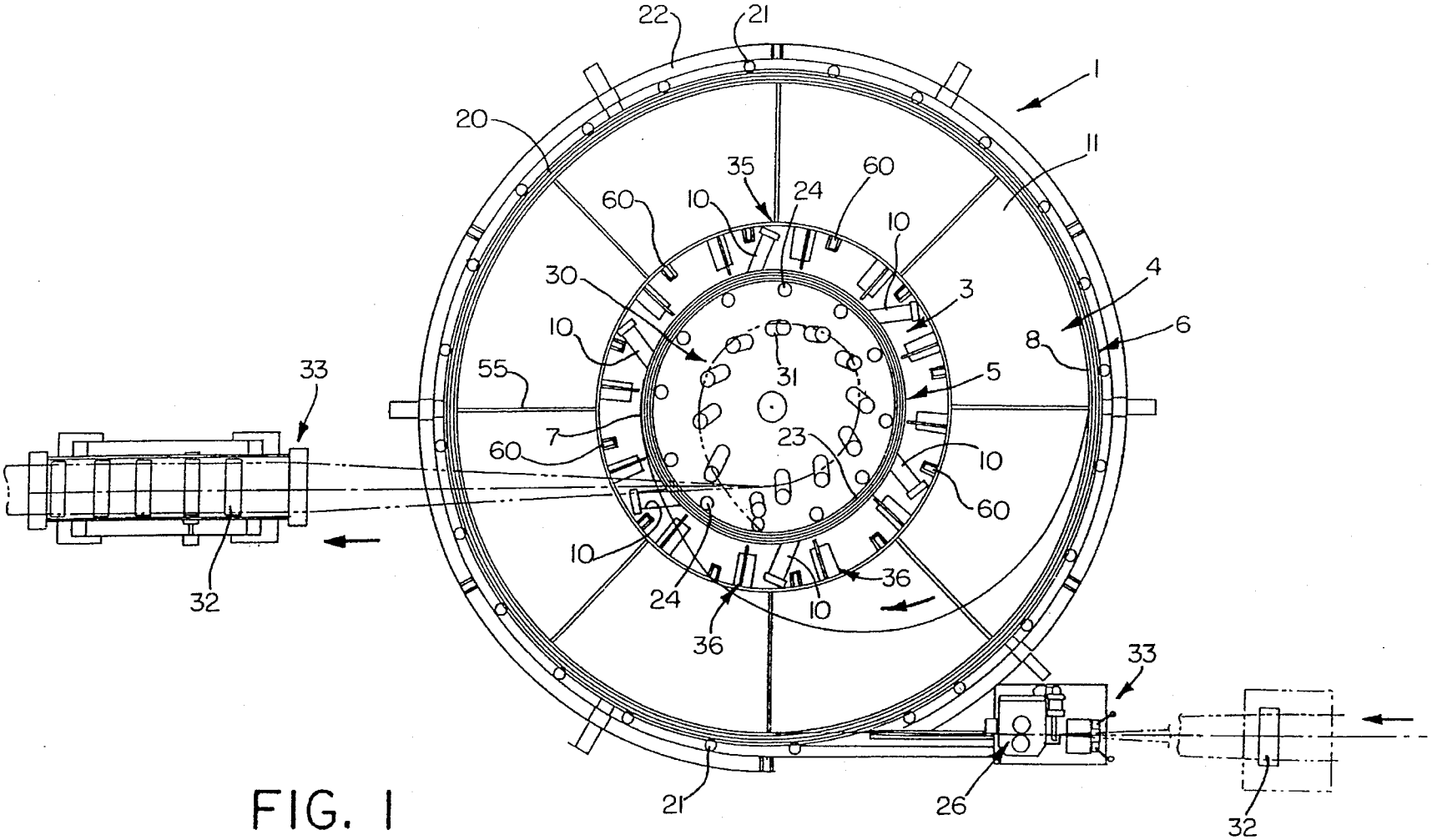
FIG. 1 is a schematic top plan view of a preferred form of strip accumulator in accordance with this invention.
Figure 2:
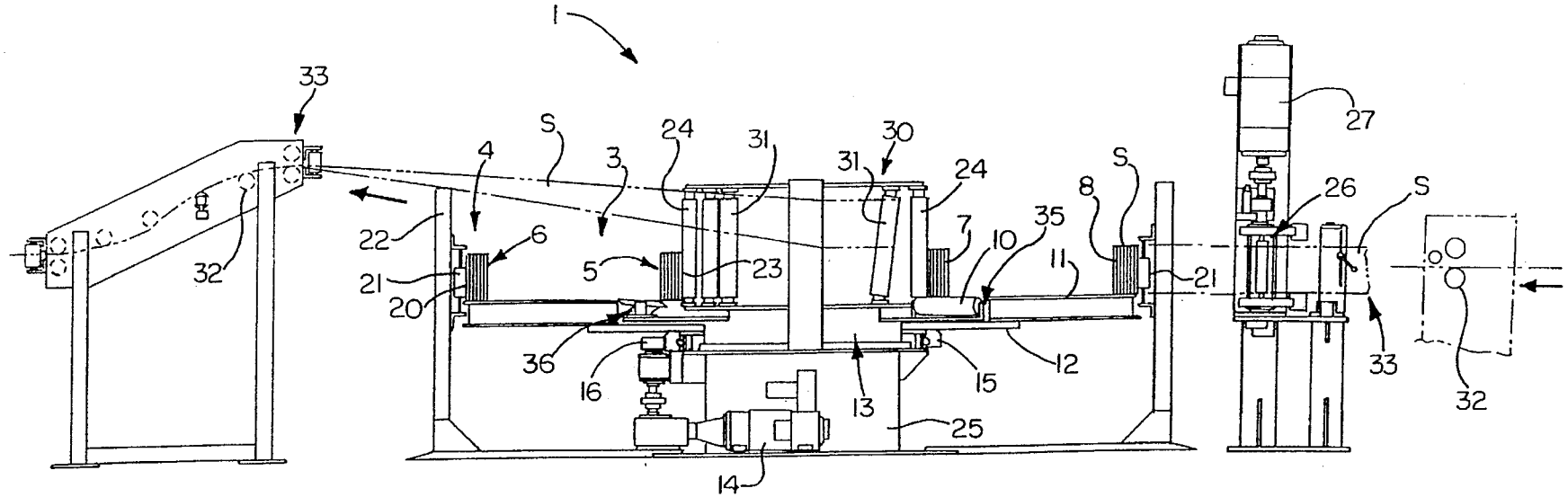
FIG. 2 is a schematic side elevation view, partly in section, of the accumulator of FIG. 1.

Referring now in detail to the drawings and initially to FIGS. 1 and 2, there is shown a preferred form of strip accumulator 1 in accordance with this invention which is used to provide for the storage of a continuous length of strip material S, such as sheet metal strip, taken from a source of supply, such as a coil, and fed to a mill, machine or other apparatus. Excess strip material S is stored in the accumulator 1 so as to be available for use in providing a continuous supply of the strip material to the mill or other apparatus anytime there is an interruption in the source of supply, as when it is necessary to replenish the source of supply, so the mill or other apparatus can be kept running without interruption.

The accumulator 1 includes two radially spaced sections or regions 3, 4 for the storage of a continuous length spiral coil of strip material generally arranged in two radially spaced bundles 5, 6 of strip material on edge with the axes of the strip convolutions in each bundle being substantially vertical and the outer convolution 7 of the inner bundle 5 being connected to the inner convolution 8 of the outer bundle 6 and vice versa so that the strip material is continuous. The combined number of turns or convolutions of strip material in both bundles will of course vary depending on the size of the accumulator and the desired maximum amount of strip material to be stored in the accumulator.

Since the diameters and thus the lengths of the convolutions within the outer section 4 are greater than those within the inner section 3, the transfer of the convolutions from the outer section 4 to the inner section 3 provides additional length of strip material permitting the continued withdrawal of the strip material from the accumulator during the strip replenishing mode when the source of supply of strip material is being replenished by welding or otherwise attaching the leading end of a new coil of strip material to the trailing end of a substantially spent coil as more fully described hereafter.

The convolutions which comprise the inner bundle 5 of strip material are supported on edge by a plurality of circumferentially spaced stationary idler rolls 10 which extend generally radially outward relative to the axial center of the accumulator 1. Preferably such idler rolls 10 extend at a slight angle, for example approximately twenty degrees, to the radius of the accumulator in the direction of strip flow through the accumulator as schematically shown in FIG. 1 to assist in the wrapping of the convolutions that are being transferred from the outer bundle 6 onto the inner bundle 5 during both mill match operation and when the source supply of strip material exteriorly of the accumulator is being replenished.

The convolutions which comprise the outer bundle 6 of strip material are supported on edge by a generally ring-shaped table 11 surrounding the stationary idler rolls 10. Table 11 is supported outwardly of the stationary idler rolls 10 from beneath by a support 12 that extends radially outward from a rotatably mounted central hub portion 13 beneath the idler rolls. The central hub portion 13 and thus the table 11 supported thereby are rotatably driven by a drive motor 14 through suitable gearing including a ring gear 15 on the outer diameter of the hub portion 13 engaged by a drive gear 16 suitably coupled to the drive motor.

The maximum diameter of the outermost turn 20 of the outer bundle 6 of convolutions supported by the rotatable table 11 may be determined by a circular array of rollers 21 mounted on the inner wall of a stationary outer containment ring 22 surrounding the rotatable table. The rollers 21 are vertically positioned on the containment ring 22 at a height to be contacted by the outermost turn 20 of the outer bundle when fully expanded as schematically shown in FIGS. 1 and 2.

The minimum diameter of the innermost turn 23 of the inner bundle 5 of convolutions is determined by a plurality of circumferentially spaced vertically extending inner containment rollers 24 suitably supported by the accumulator main frame 25 adjacent the radial inner periphery of the inner bundle.

The strip material S is fed into the accumulator 1 from a suitable external source of supply such as a coil of the strip material through an uncoiler or the like to the outer periphery of the outer bundle 6 of convolutions on the rotatable table 11 by a pair of entry pinch rolls 26 which are vertically aligned and radially spaced adjacent one another. One or both of the entry pinch rolls 26 are driven by a suitable drive motor 27 at a controlled speed for feeding the strip material into the accumulator.

The strip material S exits the accumulator from the innermost turn 23 of the inner bundle 5 of convolutions through a helical guide mechanism 30 located generally centrally of the accumulator. Such helical guide mechanism 30 includes a plurality of strip guide rolls 31 which together define a helical path for the outgoing strip material. The mill or other processing line which receives strip material from the accumulator may provide the power for withdrawing the strip material from the accumulator. Alternatively a separate drive (not shown) may be provided for driving exit pinch rolls during mill match operation if it was desired to have a supply of tension-free strip material for the mill.

Suitable guide rolls 32 are provided for supporting the strip material during its movement both from the external supply to the accumulator and from the accumulator to the strip processing line. Also, suitable turning mechanisms 33 may be provided for turning the strip material from the horizontal to the vertical before entering the accumulator and from the vertical to the horizontal after leaving the accumulator and before entering the processing line.

Because the table 11 which supports the outer bundle 6 of convolutions is mounted for rotation relative to the stationary idler rolls 10 which support the inner bundle 5, the rate at which the accumulator 1 can be filled to the desired capacity is much greater than would otherwise be possible. The fill rate is limited substantially only by the horsepower of the motors 14 and 27 used to drive the rotatable table 11 and entry pinch rolls 26. However, at the higher fill speeds (which may be substantially in excess of 2.6 times the maximum line speed), there is a substantial risk that the outer convolutions of the inner bundle 5 will expand too rapidly and get hung up in the gap 35 between the stationary idler rolls 10 and rotating table 11. To prevent that from happening, one or more lifter mechanisms 36 are mounted adjacent each of the stationary idler rolls 10 below such gap. In the embodiment disclosed herein, two such lifter mechanisms 36 are mounted adjacent opposite sides of each idler roll.

Figure 3:
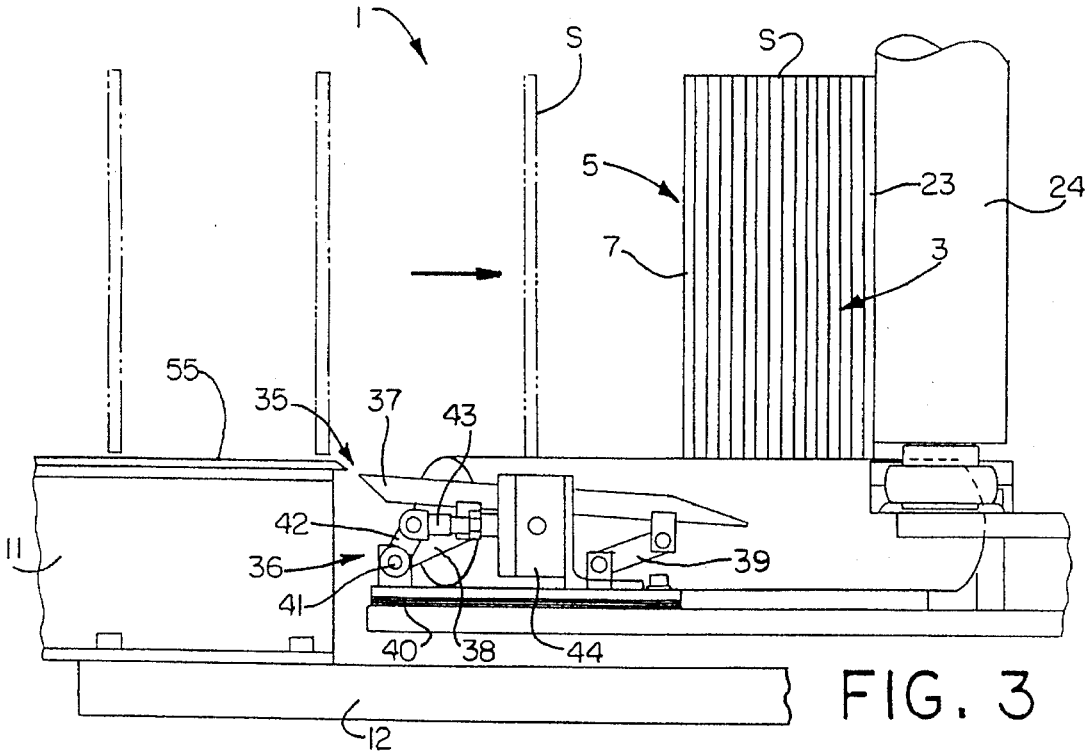
FIGS. 3 and 5 are enlarged fragmentary transverse sections through the accumulator of FIG. 1 showing one of the lifters in the gap between the outer rotatable table and inner stationary idler rolls, FIG. 5 illustrating one such lifter in the elevated position to facilitate transfer of the strip material from the inner bundle to the outer bundle during the overspeed fill mode, and FIG. 3 illustrating such lifter in the lowered position so as not to interfere with the transfer of strip material from the outer bundle to the inner bundle both during mill match operation of the accumulator and during the strip replenishing or welding mode when movement of the incoming strip material is stopped.
Figure 4:
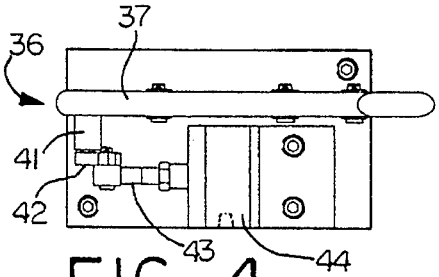
FIG. 4 is a top plan view of the lifter of FIG. 3.
Figure 5:
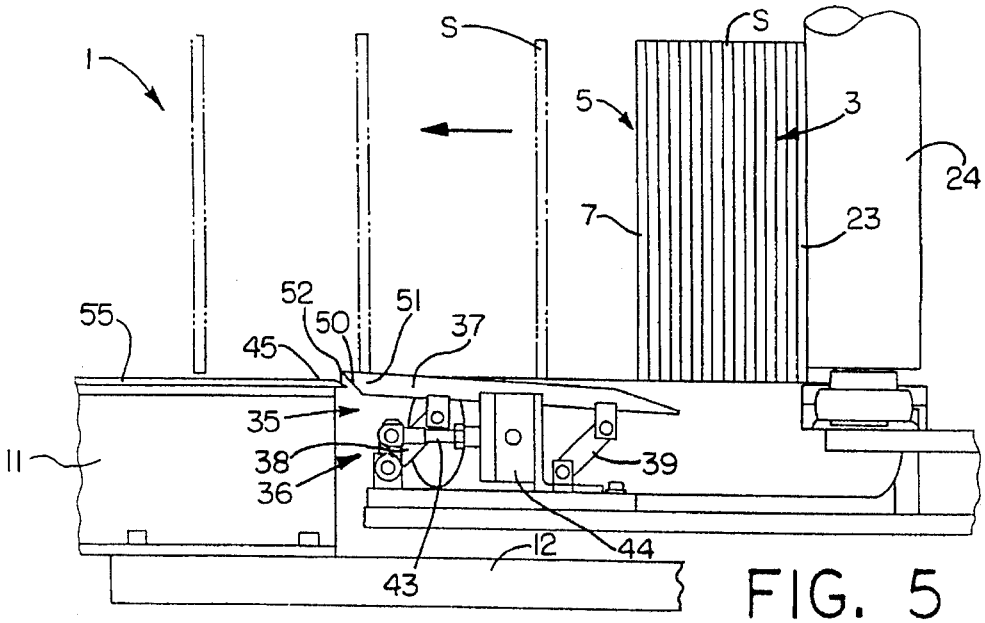

As best seen in FIGS. 3 through 5, each lifter mechanism 36 includes a lifter bar 37 supported by a pair of radially spaced apart rocker arms 38, 39 having opposite ends pivotally connected to a base portion 40 of the lifter mechanism and to the underside of the lifter bar, respectively. The lower end of one of the support arms (in this case the radially outermost arm 38) is keyed or otherwise secured to a rotatable shaft 41 to which the one end of a crank arm 42 is also fixedly connected. The other end of the crank arm 42 is pivotally connected to an axially movable output rod 43 of a suitable actuator 44.

As schematically shown in FIG. 3, when each actuator rod 43 is retracted, the lifter bars 37 are in a down position slightly below the plane of the upper surfaces of the rotatable table 11 and stationary idler rolls 10. However, when each of the actuator rods 43 is extended as schematically shown in FIG. 5, the lifter bars are raised upwardly and radially outwardly at a slight angle (i.e., approximately three and one-half degrees relative to the horizontal) so that the radial outer ends of the lifter bars intersect and extend slightly above the plane of the upper surfaces of the stationary idler rolls and rotatable table. Such angular orientation of the lifter bars when in the raised position may be obtained by making the radial inner rocker arms 39 somewhat shorter than the radial outer rocker arms 38.

When thus raised, the radial outer ends of the lifter bars 37 also desirably slightly radially overlap the radial inner edge 45 of the rotatable table 11 as by providing a radially outward and upward extending tapered surface 50 on the underside of the radial outer ends 51 of the lifter bars 37 and a correspondingly tapered upper surface 52 on the radial inner edge 45 of the table 11 (see FIG. 5). Accordingly, when the entry pinch rolls 26 and rotatable table 11 are synchronously driven with the table rotating in a clockwise direction as viewed in FIG. 1 at speeds in excess of 2.6 times the maximum line speed and the lifter bars are raised as schematically illustrated in FIG. 5, the convolutions of the inner bundle 5 of strip material will be expanded, causing such convolutions to move outwardly on the idler rolls 10 and slide up onto the lifter bars, one at a time, for depositing onto the rotating table 11 in a smooth and continuous manner.

If desired, a plurality of circumferentially spaced, radially extending skid bars 55 may be mounted on the upper surface of the table 11 for supporting the outer bundle 6 to reduce the drag on the strip material during transfer of the convolutions from the inner bundle 5 to the outer bundle 6 during overspeed filling of the accumulator.

When the accumulator 1 is filled to the desired capacity, the actuator rods 43 are retracted to cause the lifter bars 37 to move to the down position shown in Fig. 3 where they will not interfere with the transfer of strip material S from the outer bundle 6 to the inner bundle 5. As long as there is an adequate external source of supply of the strip material, the rate of infeed of the strip material to the accumulator by the entry pinch rolls 26 and rate of rotation of the table 11 in the clockwise direction as viewed in FIG. 1 may be matched with the rate of outfeed of the strip material from the accumulator so that the mill or other strip processing line pulls the strip material out of the accumulator with little more tension than required for direct pulling of the strip material from an uncoiler. During such mill match operation, the strip material will be transferred from the outer bundle 6 to the inner bundle 5 at the same rate at which strip material is fed into the outer diameter of the outer bundle by the entry pinch rolls 26 and withdrawn from the inner diameter of the inner bundle 5 by the mill line.

When the external source of supply of strip material is substantially used up, an end detector or the like (not shown) signals the approaching trailing end of the incoming strip at which time the table 11 is stopped from rotating and the incoming strip material is stopped as by stopping the entry pinch rolls 26 so that the leading end of a new coil of strip material can be moved into position and welded or otherwise joined to the trailing end of the incoming strip material. During the strip replenishing or welding mode, the convolutions in the outer bundle 6 will be transferred one at a time, from the inside out, to the outer diameter of the inner bundle 5 to provide for the uninterrupted withdrawal of the stored length of strip material from the accumulator to the processing line.

Figure 6:
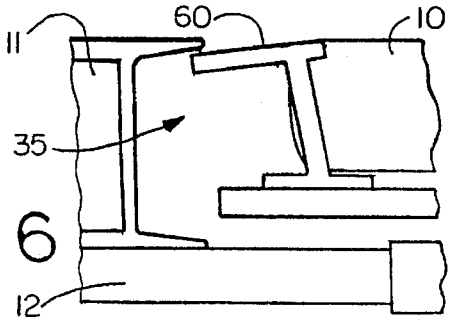
FIG. 6 is an enlarged fragmentary transverse section through the accumulator of FIG. 1 showing one of the fixed angled rods or bars positioned between the rotatable table and stationary idler rolls to prevent irregular or bent strip material from getting hung up in such gap during transfer of the strip convolutions from the rotatable table to the stationary idler rolls.

To prevent irregular or bent strip from getting hung up in the gap 35 between the table 11 and stationary idler rolls 10 during transfer of the strip convolutions from the outer bundle to the inner bundle, a plurality of relatively short radially extending rods or bars 60 may be mounted in circumferentially spaced relation within the gap 35 between the stationary idler rolls 10 and lifter mechanisms 36 (see FIG. 1). As schematically illustrated in FIG. 6, the rods 60 are desirably tucked under the radial inner edge of the table 11 a small amount and extend radially inwardly and upwardly at a slight angle, terminating substantially in the plane of the upper radial outer ends of the idler rolls 10.

From the foregoing, it will now be apparent that the strip accumulator of the present invention provides for the overspeed filling of the accumulator with strip material at speeds well in excess of 2.6 times the maximum processing line speed, with the filling speed being limited substantially only by the horsepower of the motors used to drive the rotary table and the entry pinch rolls.

Although the invention has been shown and described with respect to a certain preferred embodiment, it is obvious that equivalent alterations and modifications will occur to others skilled in the art upon the reading and understanding of the specification. The present invention includes all such equivalent alterations and modifications and is limited only by the scope of the claims.

What is claimed is:

1. A strip accumulator for supporting a continuous length of strip material consisting of a plurality of convolutions having substantially vertical axes comprising a plurality of circumferentially spaced, generally radially extending stationary idler rolls for supporting an inner bundle of such convolutions on edge, a rotatable outer support surrounding said stationary idler rolls for supporting an outer bundle of such convolutions on edge, said stationary idler rolls and said outer support having a gap therebetween, a drive mechanism for rotating said outer support around said stationary idler rolls during filling of said accumulator with the strip material, a plurality of circumferentially spaced lifters positioned between said stationary idler rolls adjacent radial outer ends of said stationary idler rolls, and actuator mechanisms for positioning said lifters in a lower position below a plane defined by upper surfaces of said stationary idler rolls during the transfer of the convolutions of said outer bundle from said outer support to said stationary idler rolls and in a raised position intersecting such plane for lifting the convolutions of said inner bundle off said stationary idler rolls and transferring such convolutions to said outer support as the convolutions of said inner bundle expand during filling of said accumulator with the strip material.

2. The accumulator of claim 1 wherein said lifters intersect such plane at an upward and radial outward angle when in the raised position.

3. The accumulator of claim 2 wherein said lifters slightly overlap a radial inner edge of said outer support when in the raised position.

4. The accumulator of claim 2 wherein said lifters have radial outer tapered surfaces which slightly overlap a radial inner edge of said outer support when said lifters are in the raised position.

5. The accumulator of claim 4 wherein each of said actuator mechanisms comprises a pair of radially spaced rocker arms pivotally connected to said lifters causing rocking movement of said lifters between said lower and raised positions.

6. The accumulator of claim 5 wherein a radial outermost one of said rocker arms is longer than a radial innermost one of said rocker arms causing said lifters to extend at an upward and radial outward angle when moved to the raised position.

7. The accumulator of claim 5 further comprising a shaft to which one of said rocker arms is affixed in spaced relation from said lifters, a crank arm affixed to said shaft in spaced relation to said one rocker arm, and an actuator rod pivotally connected to said crank arm in spaced relation to said shaft.

8. The accumulator of claim 1 wherein said stationary idler rolls extend at an angle of approximately twenty degrees to the radius of said accumulator in the direction of strip flow through said accumulator.

9. The accumulator of claim 1 wherein said outer support comprises a generally ring-shaped table surrounding said stationary idler rolls.

10. The accumulator of claim 9 further comprising circumferentially spaced, radially extending skid bars on an upper surface of said table for supporting said outer bundle of convolutions on edge on said table.

11. The accumulator of claim 10 further comprising a rotatably mounted central hub portion to which said table is connected below said stationary idler rolls for rotation of said table with said rotatable central hub portion.

12. The accumulator of claim 9 further comprising a drive motor for rotating said table at speeds in excess of 2.6 times the speed of a processing line which receives strip material from said accumulator.

13. The accumulator of claim 12 further comprising entry pinch rolls for feeding strip material from an external source to an outer diameter of said outer bundle of convolutions at the same speed at which said table is rotated.

14. The accumulator of claim 13 further comprising a helical guide mechanism for guiding outgoing strip material from an inner diameter of said inner bundle.

15. The accumulator of claim 1 further comprising a plurality of radially extending bars mounted in circumferentially spaced relation in said gap between said stationary idler rolls and said lifters for preventing irregular or bent strip material from getting hung up in said gap during transfer of the convolutions of said outer bundle to said inner bundle.

16. The accumulator of claim 15 wherein said outer support comprises a rotatable table, and said bars have radial outer ends tucked under a radial inner edge of said table, and radial inner ends terminating substantially in the plane of the upper surfaces of said stationary idler rolls at radial outer ends of said stationary idler rolls.

17. The accumulator of claim 16 wherein said bars extend radially inwardly and upwardly from said radial outer ends of said bars to said radial inner ends.

18. The accumulator of claim 1 further comprising a stationary outer containment member surrounding said outer rotatable support for determining the maximum diameter of the outermost convolution of said outer bundle.

19. The accumulator of claim 18 further comprising vertically oriented rollers on said outer containment member which are engageable by the outermost convolution of said outer bundle to reduce drag on said outer bundle during rotation of said outer bundle relative to said stationary outer containment member.

20. The accumulator of claim 1 further comprising a plurality of circumferentially spaced, vertically extending inner containment rollers positioned radially inwardly of said inner bundle of convolutions for determining the minimum diameter of the innermost convolution of said inner bundle.

21. The accumulator of claim 20 further comprising entry pinch rolls for feeding the strip material from an exterior source of supply of the strip material to the outer diameter of said outer bundle of convolutions, and a helical guide mechanism for guiding outgoing strip material from the inner diameter of said inner bundle of convolutions.

22. A strip accumulator for supporting a continuous length of strip material comprising a plurality of circumferentially spaced, generally radially extending stationary idler rolls for supporting an inner bundle of convolutions of such strip material on edge, a rotatable table surrounding said stationary idler rolls for supporting an outer bundle of convolutions of such strip material on edge, a plurality of circumferentially spaced lifters positioned between said stationary idler rolls adjacent radial outer ends of said stationary idler rolls, and actuator members for moving said lifters between a lower position below a plane defined by upper surfaces of said stationary idler rolls during the transfer of the convolutions of said outer bundle from said outer support to said stationary idler rolls and a raised position for lifting the convolutions of said inner bundle off said stationary idler rolls and transferring such convolutions to said rotatable table as the convolutions of said inner bundle expand during filling of said accumulator with the strip material.

23. The accumulator of claim 22 wherein said lifters intersect such plane when in the raised position.

24. The accumulator of claim 23 wherein said lifters slightly overlap a radial inner edge of said rotatable table when in the raised position.

25. The accumulator of claim 23 further comprising a plurality of radially extending bars mounted in circumferentially spaced relation in said gap between said stationary idler rolls and said lifters for preventing irregular or bent strip material from getting hung up in said gap during transfer of the convolutions of said outer bundle from said outer support to said stationary idler rolls.

26. The accumulator of claim 25 wherein said bars have radial outer ends tucked under a radial inner edge of said table and radial inner ends terminating substantially in the plane of the upper surfaces of said stationary idler rolls at radial outer ends of said stationary idler rolls.

* * * * *